US010857787B2

(12) United States Patent
Arima et al.

(10) Patent No.: US 10,857,787 B2
(45) Date of Patent: Dec. 8, 2020

(54) INKJET RECORDING DEVICE

(71) Applicant: Hitachi Industrial Equipment Systems Co., Ltd., Tokyo (JP)

(72) Inventors: Takahiro Arima, Tokyo (JP); Akira Maeda, Tokyo (JP); Mamoru Okano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/681,711

(22) Filed: Aug. 21, 2017

(65) Prior Publication Data

US 2018/0050535 A1 Feb. 22, 2018

(30) Foreign Application Priority Data

Aug. 22, 2016 (JP) ..... 2016-161623

(51) Int. Cl.

| | |
|---|---|
| ***B41J 2/04*** | (2006.01) |
| ***B41J 2/045*** | (2006.01) |
| ***B41J 2/185*** | (2006.01) |
| ***B41J 2/08*** | (2006.01) |
| ***B41J 2/085*** | (2006.01) |
| *B41J 2/07* | (2006.01) |

(Continued)

(52) U.S. Cl.

CPC ..... *B41J 2/04555* (2013.01); *B41J 2/04586* (2013.01); *B41J 2/08* (2013.01); *B41J 2/085* (2013.01); *B41J 2/185* (2013.01); *B41J 2/07* (2013.01); *B41J 2/175* (2013.01); *B41J 2002/022* (2013.01); *B41J 2002/032* (2013.01); *B41J 2002/1853* (2013.01)

(58) Field of Classification Search

None

See application file for complete search history.

(56) References Cited

U.S. PATENT DOCUMENTS 4,303,924 A * 12/1981 Young, Jr. ..... C09D 11/36 347/100
5,455,614 A * 10/1995 Rhodes ..... B41J 2/09 347/74

(Continued)

FOREIGN PATENT DOCUMENTS

JP 2010-131917 A 6/2010
JP 2012-66422 A 4/2012

(Continued)

OTHER PUBLICATIONS

Extended European Search Report issued in counterpart European Application No. 17187243.5 dated Jul. 31, 2018 (eight (8) pages).

(Continued)

*Primary Examiner* — Erica S Lin

(74) *Attorney, Agent, or Firm* — Crowell & Moring LLP

(57) ABSTRACT

Provided is an inkjet recording device, including a print head that includes a head base including: a nozzle from which ink is ejected; charging electrodes that charge the ink ejected from the nozzle; deflection electrodes that deflect the ink charged by the charging electrodes; and a gutter that collects ink not used in printing, and a head cover included in the head base, wherein the head base has a first horizontal uneven side portion, an oblique uneven side portion, and a second horizontal uneven side portion.

14 Claims, 8 Drawing Sheets

(51) Int. Cl.

| | |
|---|---|
| *B41J 2/175* | (2006.01) |
| *B41J 2/02* | (2006.01) |
| *B41J 2/03* | (2006.01) |

(56) References Cited

U.S. PATENT DOCUMENTS

2002/0015081 A1* 2/2002 Okazaki ..... B41J 2/14024 347/65
2006/0050113 A1* 3/2006 Sakurai ..... B41J 2/175 347/85
2007/0252866 A1* 11/2007 Kudo ..... B41J 2/16532 347/30
2009/0167795 A1* 7/2009 Yokouchi ..... B41J 2/175 347/6
2009/0189960 A1* 7/2009 Matsuda ..... B41J 2/03 347/77
2011/0148965 A1* 6/2011 Taira ..... B41J 2/16526 347/14
2011/0221834 A1* 9/2011 Otte ..... B41J 2/02 347/73
2012/0194586 A1* 8/2012 Harada ..... B41J 2/075 347/11
2014/0043414 A1* 2/2014 Arima ..... B41J 2/185 347/90
2016/0325545 A1 11/2016 Kurihara et al.

FOREIGN PATENT DOCUMENTS

WO WO-2013173200 A1 * 11/2013 ..... B41J 2/185
WO WO 2015/105031 A1 7/2015

OTHER PUBLICATIONS

European Office Action issued in counterpart European Application No. 17187243.5 dated Mar. 14, 2019 (four (4) pages).
Extended European Search Report issued in counterpart European Application No. 18185934.9 dated Mar. 25, 2019 (nine pages).

* cited by examiner

INKJET RECORDING DEVICE

INCORPORATION BY REFERENCE

The present application claims priority from Japanese application JP2016-161623 filed on Aug. 22, 2016, the content of which is hereby incorporated by reference into this application.

BACKGROUND OF THE INVENTION

1. Field of the Invention

The present invention relates to an inkjet recording device that performs printing by ejecting ink from a nozzle.

2. Description of the Related Art

As a related art in the present technical field, JP 2012-66422 A discloses a so-called continuance type inkjet recording device. This inkjet recording device includes an ink container that contains ink used to print on a printed object; a plurality of nozzles that are connected to the ink container and from which ink is ejected; a forked path connecting from the ink container to the nozzles; a flow control valve installed on a pipe connecting from the forked path to the nozzles; charging electrodes that charge ink to be ejected from the nozzles and used to print; deflection electrodes that deflect the ink charged by the charging electrodes; and a gutter for collecting ink not used in the printing.

In an inkjet recording device, if a print head, which ejects ink used to print on a printed object, is kept at a distance from the printed object, printed contents may be in disorder, or may have a larger size than a required character size; therefore, the print head needs to be brought to a certain close distance to the printed object. However, an obstacle to the installation of the print head may be installed around the printed object; therefore, to improve the installability, the size of the print head is preferably as small as possible. Especially in a case of a print head having a plurality of nozzles, the number of parts incorporated in the print head increases, which may cause the size of the print head to be larger than that of one having a single nozzle; therefore, it is necessary to adopt a technique to achieve a compact structure.

Then, a head cover protecting the print head may sometimes be removed to do maintenance of internal parts of the print head. Therefore, the print head preferably has a structure in which the head cover can be easily removed.

Furthermore, in an inkjet recording device including a plurality of nozzles, an ink collection path for collecting ink not used in printing sucks in ink on a plurality of gutters with a single ink collection pump. Therefore, paths connected to the gutters merge into one path, and this path is connected to the ink collection pump. The gutters suck in ambient air while sucking in and collecting ink particles. Here, if the flow rate of air sucked out from the gutters is low, this may lead to the overflow of ink from the gutters. Furthermore, if the flow rate of air sucked out from the gutters is high, the volatilization amount of ink solvent on the ink collection path increases as well, which leads to an increase in running cost. Therefore, the flow rate of air sucked out from the gutters is preferably adjusted to the optimal flow rate. Accordingly, in an inkjet recording device including a plurality of nozzles, it is necessary to adopt a technique to adjust the flow rate of air sucked out from the gutters.

An object of the present application is to provide an inkjet recording device including a compact print head with the improved maintainability.

Furthermore, another object of the present application is to provide an inkjet recording device including a plurality of nozzles capable of individually controlling the flow rate of air sucked out from a plurality of gutters.

SUMMARY OF THE INVENTION

To solve the above-described problems, for example, a configuration disclosed in claims is adopted.

The present application includes several means for solving the above-described problems, and, for example, an inkjet recording device that includes a print head that includes: a head base including: a nozzle from which ink is ejected; charging electrodes that charge the ink ejected from the nozzle; deflection electrodes that deflect the ink charged by the charging electrodes; and a gutter that collects ink not used in printing, and a head cover included in the head base, in which the head base has a first horizontal uneven side portion, an oblique uneven side portion, and a second horizontal uneven side portion.

According to the present invention, it is possible to provide an inkjet recording device including a compact print head with the improved maintainability.

Other objects, features and advantages of the invention will become apparent from the following description of the embodiments of the invention taken in conjunction with the accompanying drawings.

DESCRIPTION OF THE EMBODIMENTS

Embodiments of the present invention will be described below with accompanying drawings. Incidentally, the present invention is not limited to the embodiments described below.

[External Configuration of the Device]

Figure 9:
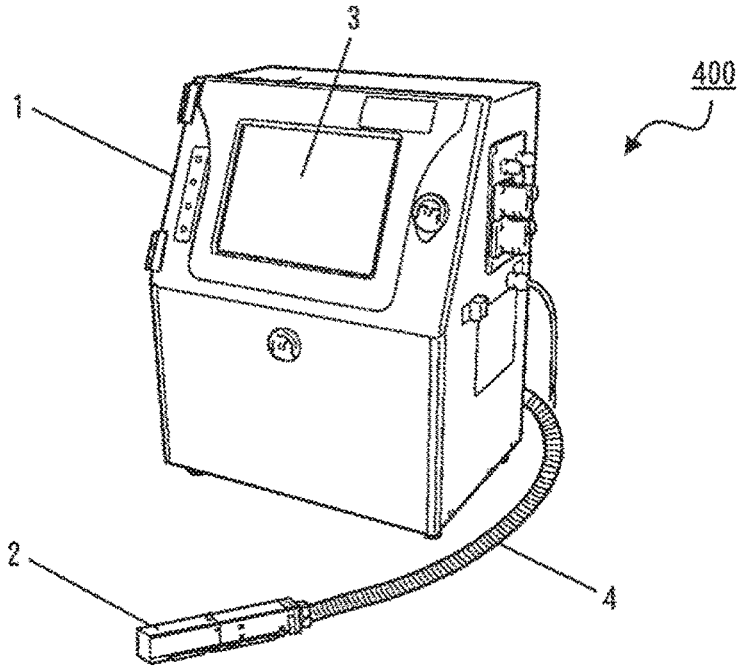
FIG. 9 is an external perspective view of an inkjet recording device.

FIG. 9 is an external perspective view of an inkjet recording device 400 according to Embodiment 1. In FIG. 9, 1 denotes a device body; 2 denotes a print head; 3 denotes an operation display unit; and 4 denotes a duct. The inkjet recording device 400 includes the operation display unit 3 inside the device body 1, and includes the print head 2 outside the device body 1; the device body 1 and the print head 2 are connected by the duct 4.

[Usage of the Device]

Figure 10:
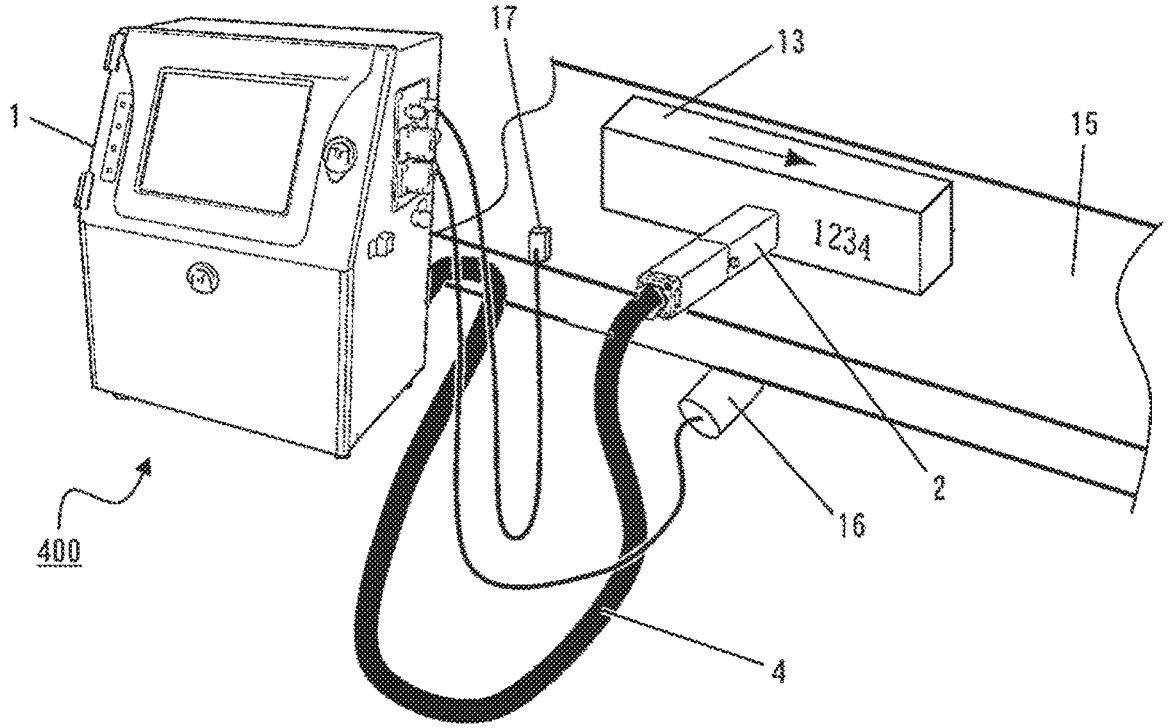
FIG. 10 is a perspective view showing the state of usage of the inkjet recording device.

Subsequently, the usage state of the inkjet recording device 400 is described with FIG. 10. In FIG. 10, 1 denotes a device body; 2 denotes a print head; 4 denotes a duct; 13 denotes a printed object on which number(s) or character(s) is to be printed; 15 denotes a conveyor belt that conveys the printed object 13; 16 denotes a rotary encoder that measures the conveying distance of the conveyor belt 15; and 17 denotes a print sensor.

The inkjet recording device 400 is installed in a production line of a factory that produces, for example, foods or beverages; the device body 1 is set in a position where a user can operate it, and the print head 2 is set in a position where it can be brought close to a printed object 13 being fed on the production line such as the conveyor belt 15. To print number(s) or character(s) with the same width regardless of the feed speed, the encoder 16, which outputs a signal according to the feed speed to the inkjet recording device 400, and the print sensor 17, which detects a printed object 13 and outputs a signal instructing the inkjet recording device 400 to print, are installed on the production line such as the conveyor belt 15, and they are each connected to a control unit (not shown) in the device body 1. In response to the signals output from the encoder 16 and the print sensor 17, the control unit controls the amount of electric charge applied to ink particles 7A and 7B ejected from nozzles 8A and 8B and the timing to apply the electric charge so as to print the number(s) or character(s) on the printed object 13 by attaching the charged and deflected ink particles 7A and 7B to the printed object 13 while the printed object 13 is passing by the proximity of the print head 2.

[Operating Principle of the Device]

Figure 11:
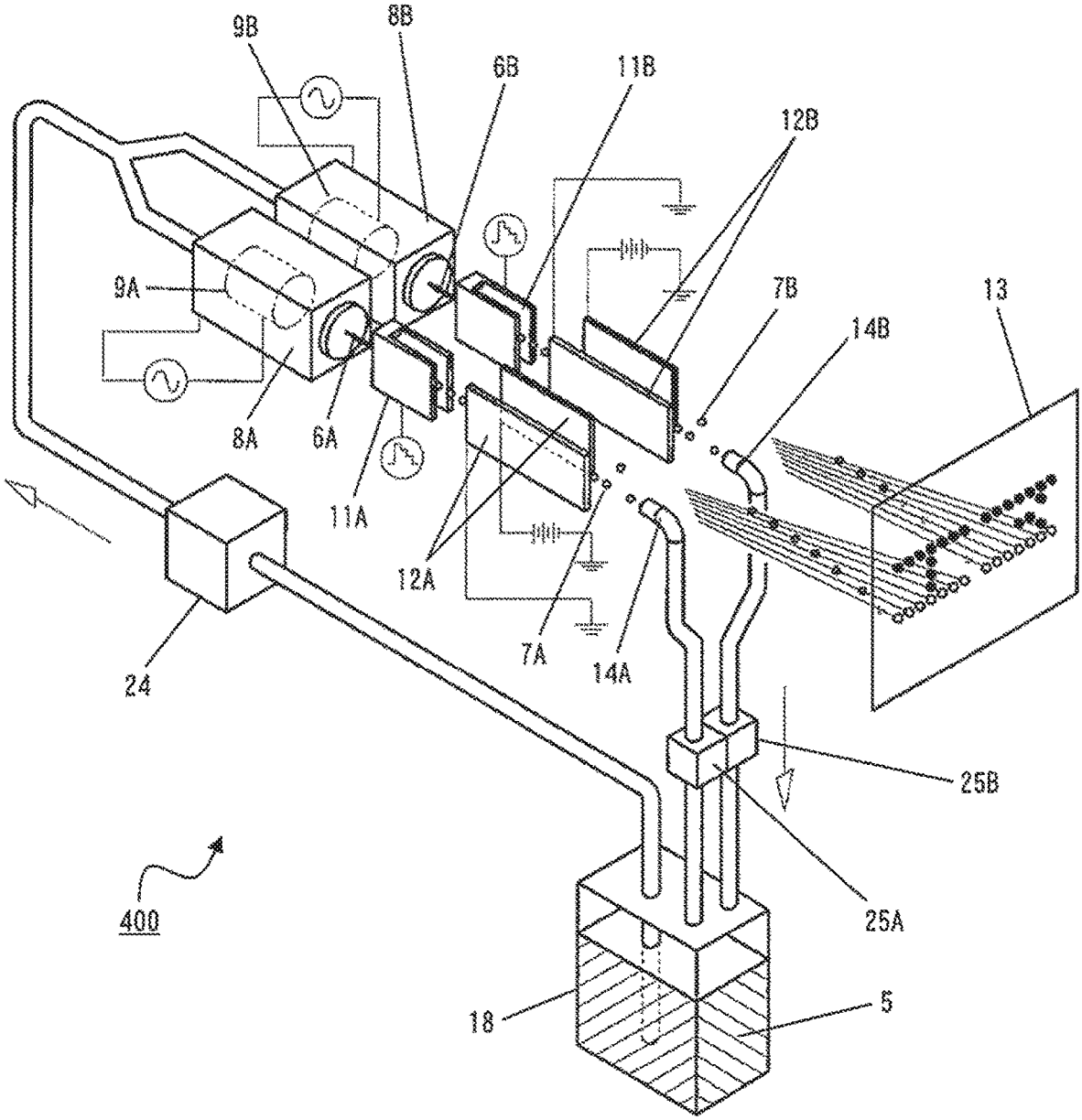
FIG. 11 is a schematic diagram showing the operating principle of the inkjet recording device.

Subsequently, the operating principle of the inkjet recording device 400 is described with FIG. 11. In FIG. 11, 18 denotes a main ink container; 5 denotes ink; 24 denotes a pump (for supply) that pressurizes and feeds the ink 5; 9A and 9B denote electrostrictive elements that vibrate at a predetermined frequency when a voltage has been applied thereto; 8A and 8B denote nozzles from which the ink 5 is ejected; 6A and 6B denote ink columns; 11A and 11B denote charging electrodes that charge ink particles; 7A and 7B denote ink particles; 12A and 12B denote deflection electrodes; 13 denotes a printed object; 14A and 14B denote gutters for collecting ink particles not used in the printing; and 25A and 25B denote pumps (for collection) that suck in the ink particles collected by the gutters 14A and 14B and feed the ink particles into the main ink container 18.

Ink 5 in the main ink container 18 is sucked out and pressurized into ink columns 6A and 6B by the pump (for supply) 24, and the ink columns 6A and 6B are ejected from the nozzles 8A and 8B, respectively. The nozzles 8A and 8B are provided with the electrostrictive elements 9A and 9B, respectively, to apply a vibration of predetermined frequency to the ink 5, thereby changing the ink columns 6A and 6B ejected from the nozzles 8A and 8B into ink particles. The number of ink particles 7A and 7B generated here is determined by a frequency of excitation voltage applied to the electrostrictive elements 9A and 9B, and is the same number as the frequency. The charging electrodes 11A and 11B apply a voltage with the magnitude corresponding to print information to the ink particles 7A and 7B, thereby the ink particles 7A and 7B carry an electrical charge.

The ink particles 7A and 7B charged by the charging electrodes 11A and 11B fly in an electric field between the deflection electrodes 12A and 12B. The deflection electric field is formed between a high-voltage electrode to which a high voltage of 5 to 6 kV is applied and an installed ground electrode; the charged ink particles 7A and 7B are deflected by a force proportional to the amount of the electric charge, and fly toward and land in a printed object 13. At the time, the ink particles 7A and 7B vary in the landing position in a deflection direction according to the amount of electric charge, and further, the production line moves the printed object 13 in a direction perpendicular to the deflection direction; therefore, it is possible to make the particles land in the deflection direction and the direction perpendicular to the deflection direction, and character(s) composed by the multiple landing particles is printed. The ink particles 7A and 7B not used in the printing linearly fly between the deflection electrodes 12A and 12B and are caught by the gutters 14A and 14B, and then are sucked in by the pumps (for collection) 25A and 25B, and are collected into the main ink container 18.

[Path Configuration in Embodiment 1]

Figure 12:
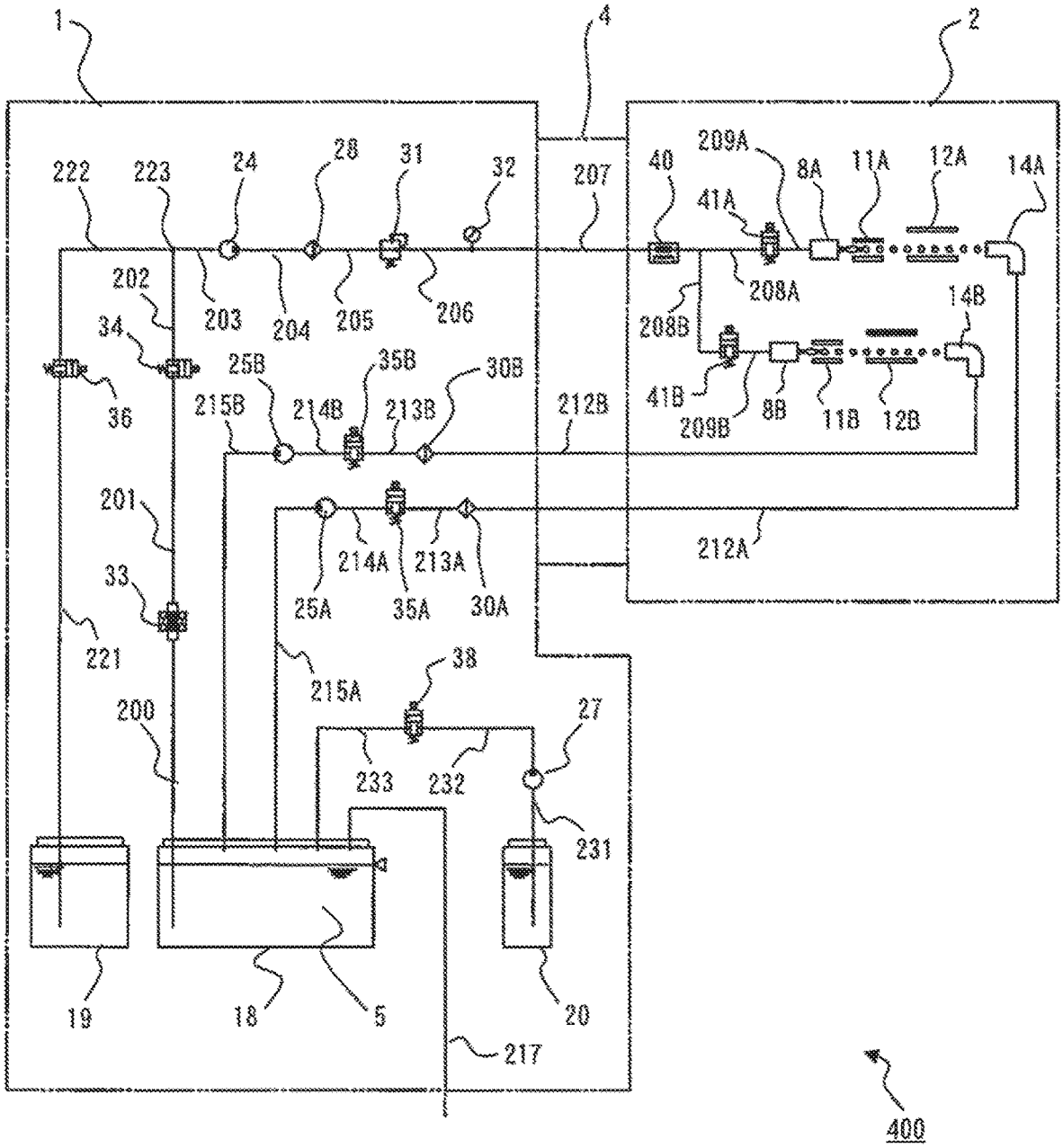
FIG. 12 is a diagram showing a path configuration of the inkjet recording device according to the present invention.

Subsequently, a path configuration of the inkjet recording device 400 is described with FIG. 12. FIG. 12 is a diagram showing an entire path configuration of the inkjet recording device 400.

The inkjet recording device 400 includes the device body 1, the print head 2, and the duct 4 connecting the device body 1 and the print head 2.

First, an ink supply path of the inkjet recording device 400 in the present embodiment is explained. The device body 1 includes the main ink container 18 that holds ink 5 circulated. To grasp the viscosity of the ink 5 in the main ink container 18, the main ink container 18 is connected to a viscosity measuring device 33 through a path 200. The viscosity measuring device 33 is connected to a solenoid valve (for supply) 34, which opens/closes a path, through a path 201, and the solenoid valve (for supply) 34 is connected to the pump (for supply) 24, which is used to suck in and pump the ink 5, through paths 202 and 203. Then, the pump (for supply) 24 is connected to a filter (for supply) 28, which removes a foreign substance mixed into the ink 5, through a path 204.

The filter (for supply) 28 is connected to a pressure reducing valve 31, which adjusts the pressure to an appropriate pressure in order to print the ink 5 pumped from the pump (for supply) 24, through a path 205, and the pressure reducing valve 31 is connected to a pressure gauge 32, which measures the pressure of the ink 5 supplied to the nozzles 8A and 8B, through a path 206. The pressure gauge 32 is connected to a heater 40 included in the print head 2 through a path 207 passing through the duct 4. The heater 40 performs heating control so that the ink 5 has an appropriate ink temperature when used in a low-temperature environment.

The heater 40 is connected to a sealing valve 41A, which opens/closes a path, through a path 208A, and the sealing valve 41A is connected to the nozzle 8A through a path 209A. The nozzle 8A is provided with an ejection port from which the ink particles 7A are ejected. The gutter 14A for catching the ink particles 7A flying straight without being charged and deflected so as not to be used in printing is installed in a straight forward direction of the ejection port of the nozzle 8A. Furthermore, the heater 40 is connected to a sealing valve 41B, which opens/closes a path, through a path 208B, and the sealing valve 41B is connected to the nozzle 8B through a path 209B. The gutter 14B for catching the ink particles 7B flying straight without being charged and deflected so as not to be used in printing is installed in a straight forward direction of the ejection port of the nozzle 8B. In this way, in the present embodiment, printing can be performed by ejecting the ink particles 7A and 7B from the two nozzles 8A and 8B; therefore, it is possible to print larger character(s) or drawing than that printed with one nozzle. Furthermore, in a case of printing character(s) or drawing with the same size and the same number of rows, two nozzles make it possible to print the character(s) or drawing faster than one nozzle does.

Next, an ink collection path of the inkjet recording device 400 in FIG. 12 is explained. The gutter 14A is connected to a filter (for collection) 30A, which is installed in the device body 1 and removes a foreign substance mixed into ink, through a path 212A passing through the duct 4, and the filter (for collection) 30A is connected to a solenoid valve (for collection) 35A, which opens/closes a path, through a path 213A. The solenoid valve (for collection) 35A is connected to the pump (for collection) 25A, which sucks in ink particles 7A caught by the gutter 14A, through a path 214A. The pump (for collection) 25A is connected to the main ink container 18 through a path 215A.

Furthermore, the gutter 14B is connected to a filter (for collection) 30B, which is installed in the device body 1 and removes a foreign substance mixed into ink, through a path 212B passing through the duct 4, and the filter (for collection) 30B is connected to a solenoid valve (for collection) 35B, which opens/closes a path, through a path 213B. The solenoid valve (for collection) 35B is connected to the pump (for collection) 25B, which sucks in ink particles 7B caught by the gutter 14B, through a path 214B. The pump (for collection) 25B is connected to the main ink container 18 through a path 215B.

Next, an exhaust air path for air mixed with solvent vapor of the inkjet recording device 400 in FIG. 12 is explained. The main ink container 18 is connected to an exhaust air path 217, and the exhaust air path 217 is configured to be communicated with the outside of the device body 1.

As the characteristics of the path configuration in the present embodiment, the nozzles 8A and 8B share the common paths 200 to 207 as the ink supply path, and, as the ink collection path, use the separate paths 212A to 215A and 212B to 215B, respectively, and share the common path 217 as the exhaust air path. In this way, only necessary paths are separated, which makes it possible to reduce the size of the device body 1 and to achieve the effects described in the above embodiment.

Next, an ink replenishment path in FIG. 12 is explained. The device body 1 includes a spare ink container 19 that holds ink for replenishment, and the spare ink container 19 is connected to a solenoid valve (for replenishment) 36, which opens/closes a path, through a path 221. Then, the solenoid valve (for replenishment) 36 is connected to a merging path 223, which is connected to the ink supply path 203, through a path 222.

Next, a solvent replenishment path of the inkjet recording device 400 in FIG. 12 is explained. The device body 1 includes a solvent container 20 that holds a solvent for replenishment, and the solvent container 20 is connected to a pump (for solvent) 27, which is used to suck in and pump the solvent, through a path 231. The pump (for solvent) 27 is connected to a solenoid valve (for solvent) 38, which opens/closes a flow path, through a path 232, and the solenoid valve (for solvent) 38 is connected to the main ink container 18 through a path 233.

[Operation in Embodiment 1]

Subsequently, the operation of the inkjet recording device 400 is described with FIG. 12. First, there is described the ink flow and the air flow in the inkjet recording device 400 according to the present embodiment when a printing operation is performed, i.e., when ink is ejected from the nozzles 8A and 8B.

In FIG. 12, when the inkjet recording device 400 is in operation to print, electric current is applied to the solenoid valve (for supply) 34, and the solenoid valve (for supply) 34 opens a flow path, and the pump (for supply) 24 runs, thereby the ink 5 retained in the main ink container 18 passes through the ink supply paths 200 to 207 and is supplied to the heater 40 inside the print head 2. Then, electric current is applied to the sealing valve 41A, and the sealing valve 41A opens a flow path, thereby the ink 5 passes through the ink supply paths 208A and 209A and is supplied to the nozzle 8A. Furthermore, electric current is applied to the sealing valve 41B, and the sealing valve 41B opens a flow path, thereby the ink 5 passes through the ink supply paths 208B and 209B and is supplied to the nozzle 8B.

Here, for example, when the hole diameter of the nozzle 8A is 65 [μm], the flow rate of ink ejected from the nozzle 8A is about 4 [ml/min]. Then, for example, when the hole diameter of the nozzle 8B is 100 [μm], the flow rate of ink ejected from the nozzle 8B is about 8 [ml/min]. The ink 5 ejected from the nozzles 8A and 8B fly in the form of ink particles 7A and 7B and pass through between the charging electrodes 11A and 11B and the deflection electrodes 12A and 12B installed in the print head 2, respectively. Then, the ink particles 7A and 7B not used in printing are configured to be caught by the gutters 14A and 14B, respectively. That is, when the inkjet recording device 400 is in operation, the flow rate of ink supplied by the pump (for supply) 24 is about 12 [ml/min] (=about 4 [ml/min]+about 8 [ml/min]). Electric current is applied to the solenoid valve (for collection) 35A, and the solenoid valve (for collection) 35A opens a flow path, and the pump (for collection) 25A runs, thereby the ink particles 7A caught by the gutter 14A pass through the ink collection paths 212A to 215A and the filter (for collection) 30A and are collected into the main ink container 18 installed in the device body 1. The pump (for collection) 25A is set to be subject to optimal control to suck about 4 [ml/min] of the ink particles 7A from the gutter 14A; in this case, the flow rate of air sucked out from the gutter 14A is about 150 [ml/min]. In the ink collection paths 212A to 215A, the ink (for example, about 4 [ml/min]) and the air (for example, about 150 [ml/min]) flow in a gas-liquid mixing state in which the ink and the air are mixed together.

Furthermore, electric current is applied to the solenoid valve (for collection) 35B, and the solenoid valve (for collection) 35B opens a flow path, and the pump (for collection) 25B runs, thereby the ink particles 7B caught by the gutter 14B pass through the ink collection paths 212B to 215B and the filter (for collection) 30B and are collected into the main ink container 18 installed in the device body 1. The pump (for collection) 25B is set to be subject to optimal control to suck about 8 [ml/min] of the ink particles 7B from the gutter 14B; in this case, the flow rate of air sucked out from the gutter 14B is about 300 [ml/min].

Here, the air flow rate control range of the pumps (for collection) 25A and 25B is 0 to 500 [ml/min], and the pumps (for collection) 25A and 25B can be controlled to have a different pump flow rate from each other. The pumps (for collection) 25A and 25B can be individually subject to optimal pump flow rate control according to the flow rate of ink ejected from the nozzles 8A and 8B, the type of ink 5, the viscosity of the ink 5, the ink supply pressure, the environmental temperature, the internal temperature of the inkjet recording device 400, the height difference between the device body 1 and the print head 2, etc.

Furthermore, as the filters (for collection) 30A and 30B differ in the flow rate of air sucked out from the gutters 14A and 14B, when the same type of filters are used, the replacement cycles of the filters are preferably set to the most appropriate time for each filter. If you want the same replacement cycle, the type or the filter medium size of the filters (for collection) 30A and 30B is preferably set to the most appropriate one.

The ink 5 used in the inkjet recording device 400 is required to dry shortly after printed, and a highly volatile solvent (for example, methyl ethyl ketone, acetone, ethanol, or the like) is used as a solvent of the ink 5. As a highly volatile solvent is used in the ink 5, the air flowing through the ink collection paths 212A to 215A and 212B to 215B is mixed with solvent vapor having a concentration close to the saturated vapor concentration.

In the main ink container 18, the ink 5 (for example, a flow rate of about 12 [ml/min]) collected from the ink collection paths 215A to 215B is stored in the bottom of the main ink container 18, and then, is again fed from the ink supply path 200 to the nozzles 8A and 8B and is reused. Furthermore, in the main ink container 18, the air mixed with solvent vapor flowing in from the ink collection paths 215A to 215B (for example, a total flow rate of about 450 [ml/min] because a flow rate of air flowing in from the ink collection path 215A is about 150 [ml/min], and a flow rate of air flowing in from the ink collection path 215B is about 300 [ml/min]) is discharged out of the device from the exhaust air path 217.

Moreover, when the inkjet recording device 400 is in operation, the air mixed with solvent vapor is discharged out of the device from the exhaust air path 217, and therefore, the ink concentration in the main ink container 18 is high. Accordingly, the solvent is periodically supplied to the main ink container 18, thereby adjusting the concentration of ink supplied to the nozzles 8A and 8B. When the solvent is being supplied, electric current is applied to the solenoid valve (for solvent) 38, and the solenoid valve (for solvent) 38 opens a flow path, and the pump (for solvent) 27 runs, thereby the solvent retained in the solvent container 20 is supplied to the main ink container 18. Reducing the amount of this solvent supplied leads to the reduction of the running cost of the inkjet recording device 400.

Next, there is described the ink flow and the air flow in the inkjet recording device 400 according to the present embodiment when only the nozzle 8A performs a printing operation, i.e., when ink is ejected from only the nozzle 8A. Electric current is applied to the sealing valve 41A, and the sealing valve 41A opens a flow path, thereby the ink 5 passes through the ink supply paths 208A and 209A and is supplied to the nozzle 8A. At this time, no electric current is applied to the sealing valve 41B, and the sealing valve 41B closes the ink supply paths 208B and 209B so that the ink 5 is not supplied to the nozzle 8B.

Electric current is applied to the solenoid valve (for collection) 35A, and the solenoid valve (for collection) 35A opens a flow path, and the pump (for collection) 25A runs, thereby the ink particles 7A caught by the gutter 14A pass through the ink collection paths 212A to 215A and the filter (for collection) 30A and are collected into the main ink container 18 installed in the device body 1. Then, no electric current is applied to the solenoid valve (for collection) 35B, and the solenoid valve (for collection) 35B can close the ink supply paths 213B and 214B, or the pump (for collection) 25B can be at a stop. This can prevent the gutter 14B from sucking in air. In this way, only the nozzle 8A used ejects ink, and the supply of the ink 5 to the nozzle 8B not used and the sucking of air from the gutter 14B are stopped, thereby the flow rate of the air mixed with solvent vapor discharged out of the device from the exhaust air path 217 is reduced as compared with that when the ink 5 is ejected from both the nozzles 8A and 8B. Accordingly, it is possible to reduce the consumption of the solvent. In the above-described control, there is described the operation when only the nozzle 8A ejects the ink 5; however, it can also be configured that only the nozzle 8B ejects the ink 5.

Furthermore, in the inkjet recording device 400 according to the present embodiment, the nozzles 8A and 8B, the gutters 14A and 14B, etc. may sometimes be cleaned with the solvent for maintenance. After repeating such cleaning, the ink 5 in the main ink container 18 may be diluted. In such a case, when the inkjet recording device 400 is in operation, the flow rate of air in the pumps (for collection) 25A and 25B can be increased, thereby making the ink 5 in the main ink container 18 concentrated. For example, the pumps (for collection) 25A and 25B in the present embodiment both allow for a maximum air flow rate of 500 [ml/min]; therefore, the flow rate of the air mixed with solvent vapor discharged out of the device from the exhaust air path 217 is about 1000 [ml/min] with a combination of the two pumps (for collection) 25A and 25B. In the above-described operation example, the ink 5 is concentrated while the nozzles 8A and 8B are ejecting the ink 5; however, the ink 5 can also be concentrated by sucking the air from the gutter 14A or 14B in a state in which at least one of the nozzle 8A and the nozzle 8B is not ejecting the ink 5.

Moreover, in the inkjet recording device 400 according to the present embodiment, the nozzles 8A and 8B can alternate the ejection of the ink 5 during maintenance on the other nozzle.

[Advantageous Effects of Embodiment 1]

In this way, according to the present embodiment, it is possible to individually control the flow rate of air sucked out from the gutters 14A and 14B; therefore, it is possible to provide the inkjet recording device 400 including the nozzles 8A and 8B capable of improving the ink collection stability of the gutters 14A and 14B and also reducing the consumption of the solvent when the inkjet recording device 400 is in operation.

Furthermore, according to the present embodiment, it is possible to provide the inkjet recording device 400 including the nozzles 8A and 8B capable of alternating the ink ejection during maintenance on the other nozzle.

Moreover, according to the present embodiment, it is possible to provide the inkjet recording device 400 including the nozzles 8A and 8B capable of making the ink 5 concentrated by using the pumps (for collection) 25A and 25B when the ink 5 in the main ink container 18 has been diluted because the solvent was used for maintenance.

The present invention is not limited to the above-described embodiment, and includes various variations. Furthermore, the above embodiment is described in detail to provide a comprehensible explanation about the present invention, and is not always limited to include all the components described above.

[Configuration in Embodiment 2]

Figure 1:
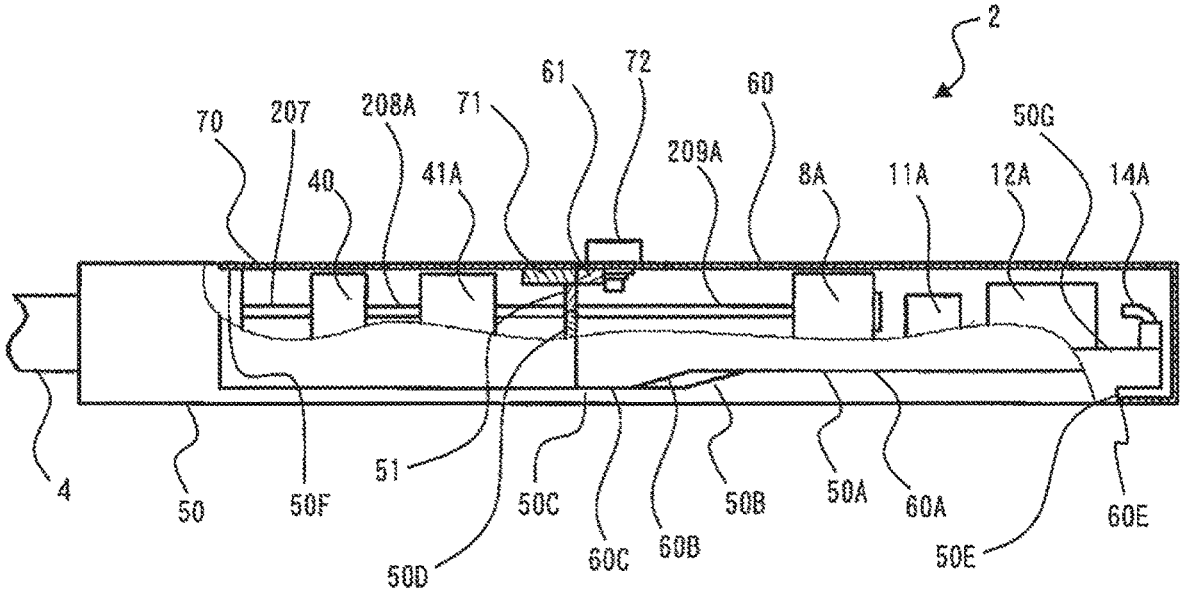
FIG. 1 is a partial cross-sectional view showing an external appearance and an internal configuration of a print head according to an embodiment of the present invention.
Figure 2:
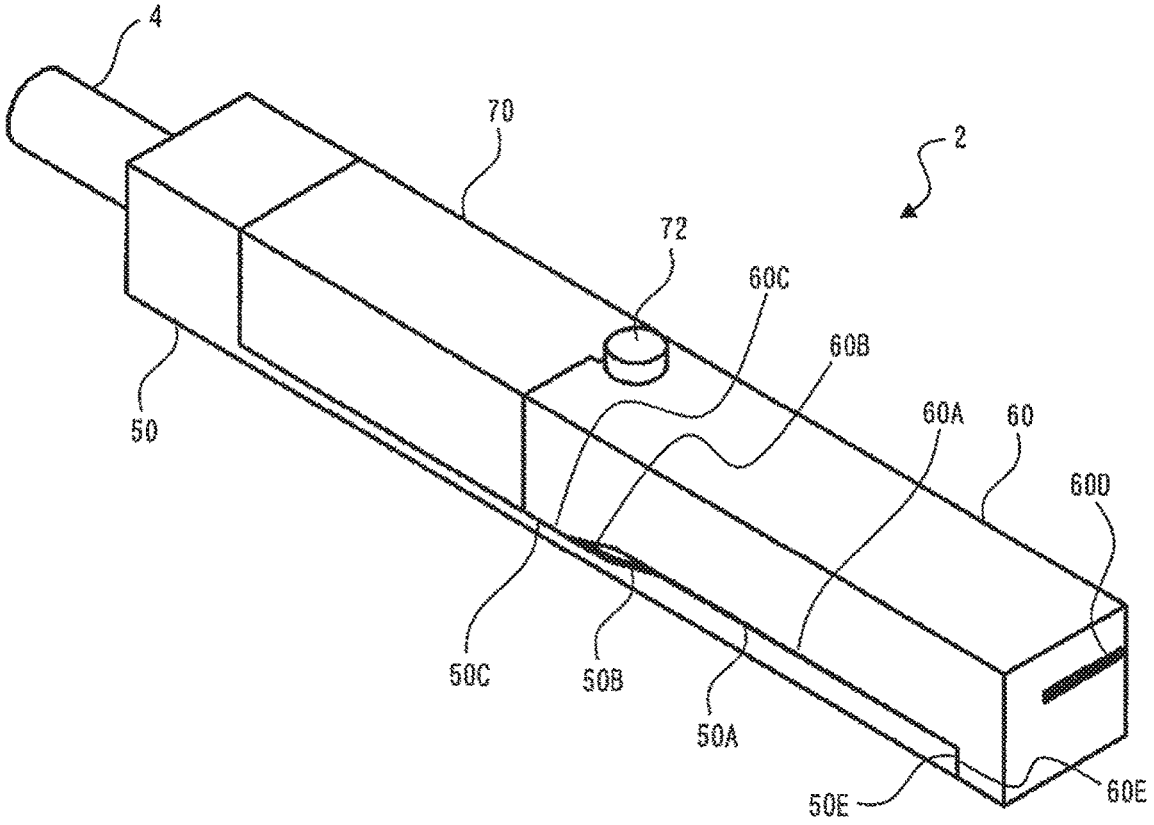
FIG. 2 is a perspective view showing the external appearance of the print head according to the embodiment of the embodiment of the present invention.
Figure 3:
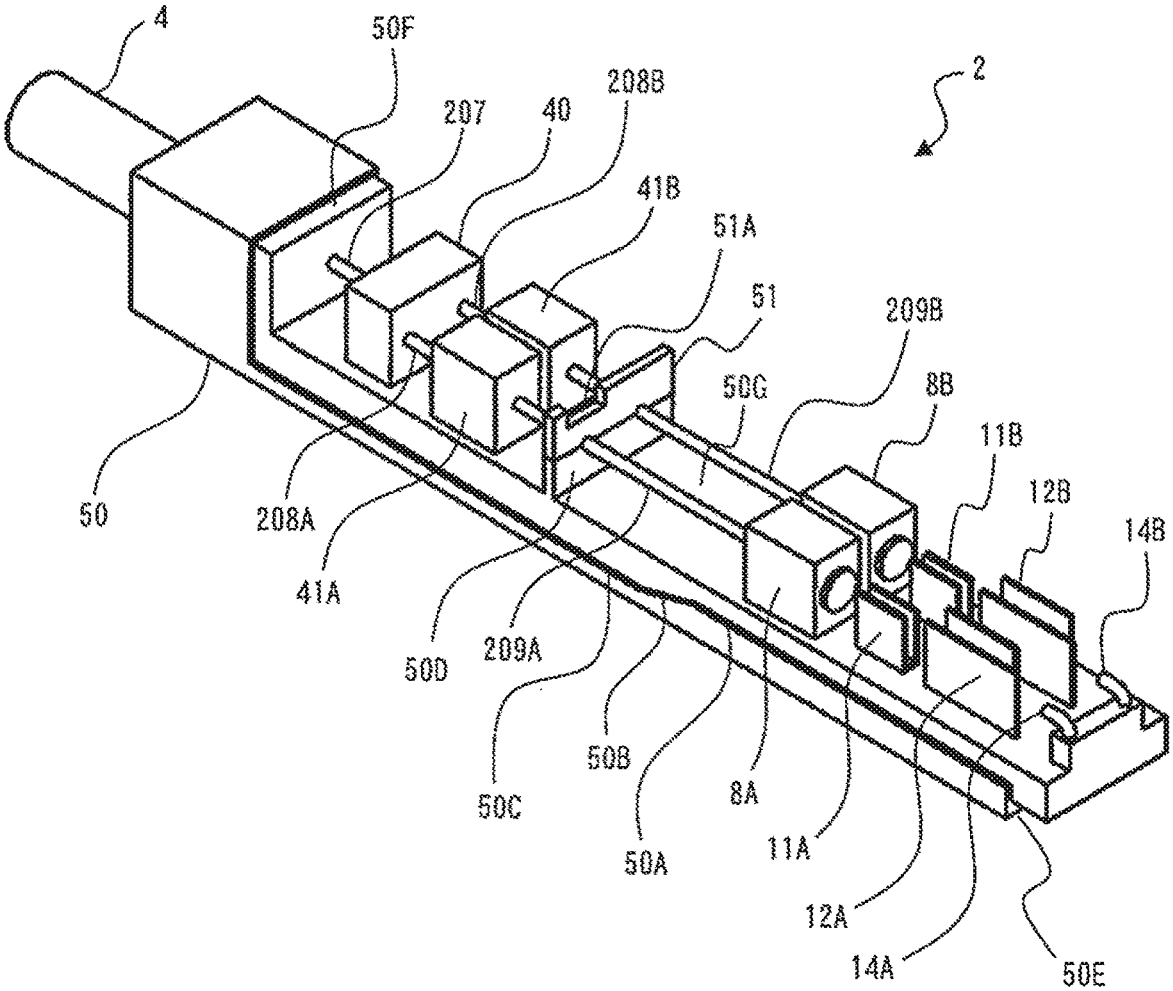
FIG. 3 is a perspective view showing the internal configuration of the print head according to the embodiment of the embodiment of the present invention, where a maintenance cover and a print head cover are removed from the print head.
Figure 4:
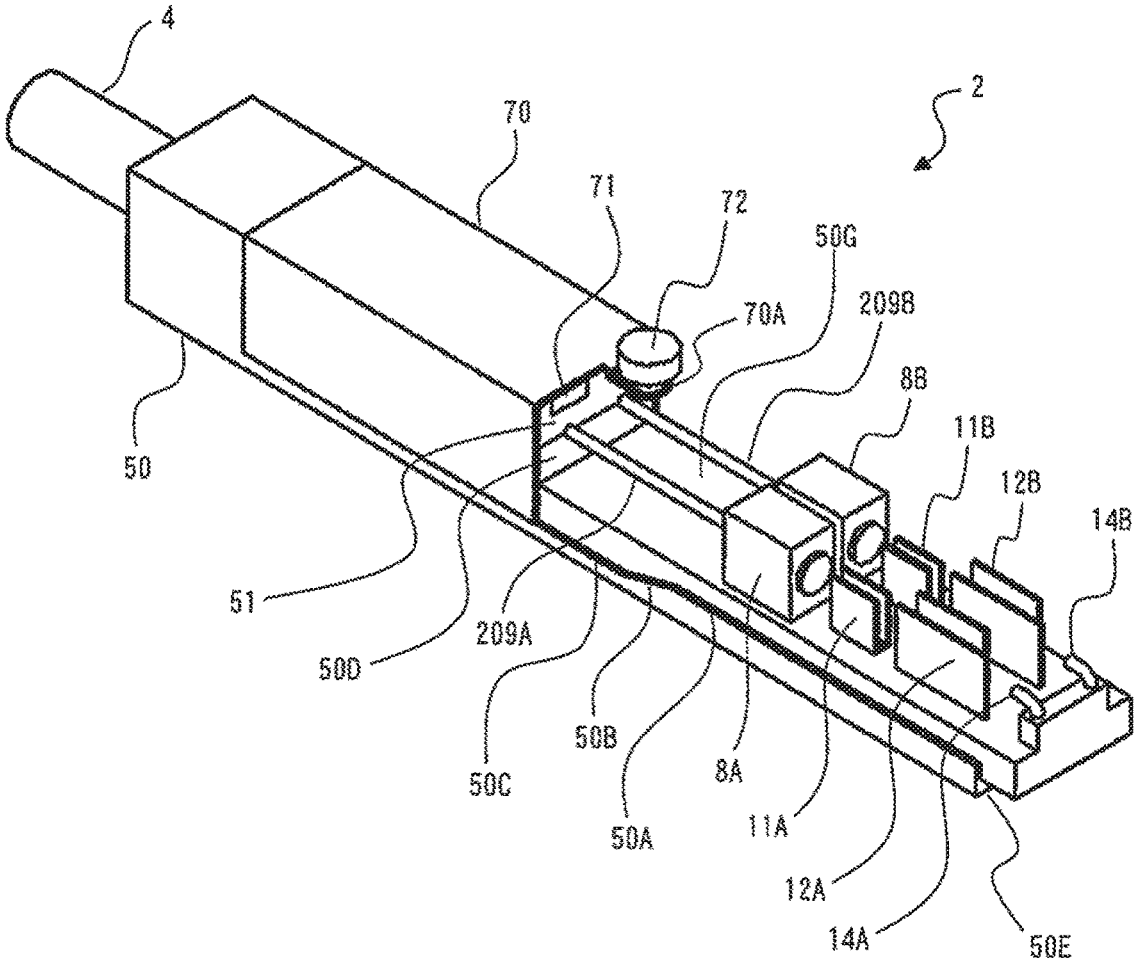
FIG. 4 is a perspective view showing a state in which the print head cover is removed from the print head according to the embodiment of the present invention.
Figure 5:
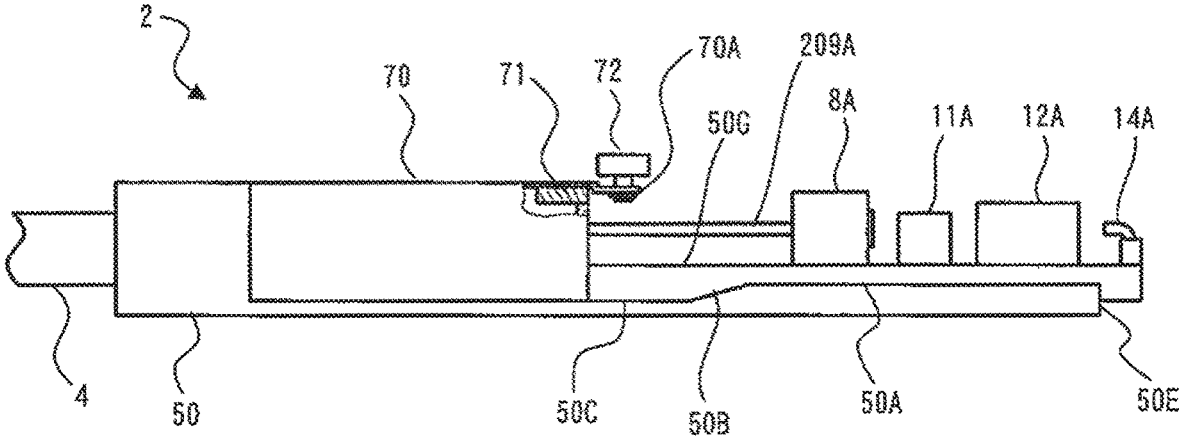
FIG. 5 is a partial cross-sectional view showing a state in which the print head cover is removed from the print head according to the embodiment of the present invention.
Figure 6A:
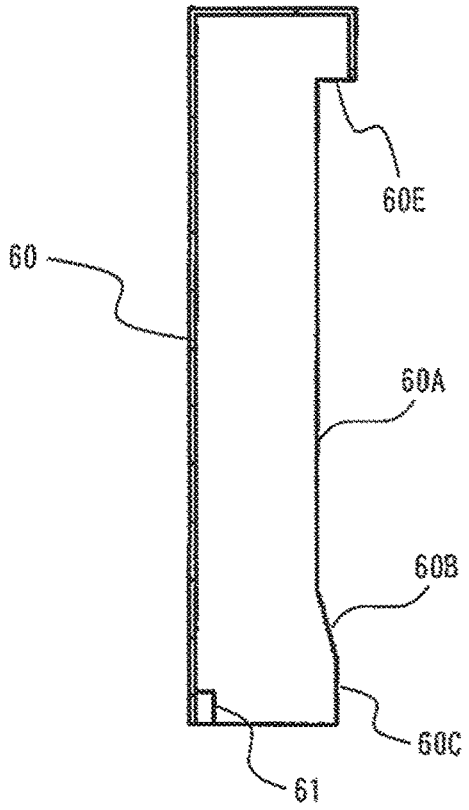
FIGS. 6A and 6B are a cross-sectional view and a bottom view of the print head cover according to the embodiment of the present invention, respectively.
Figure 6B:
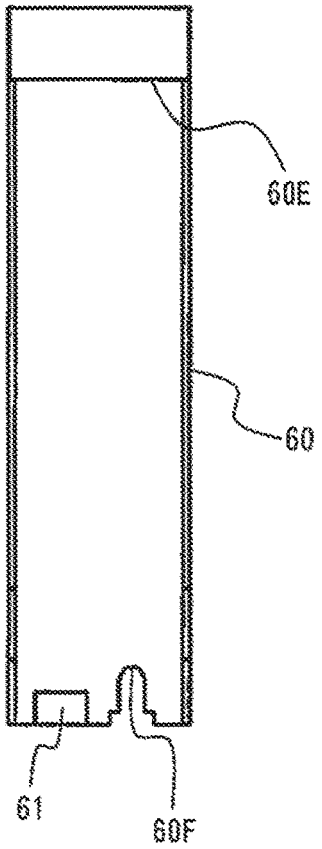
Figure 7A:
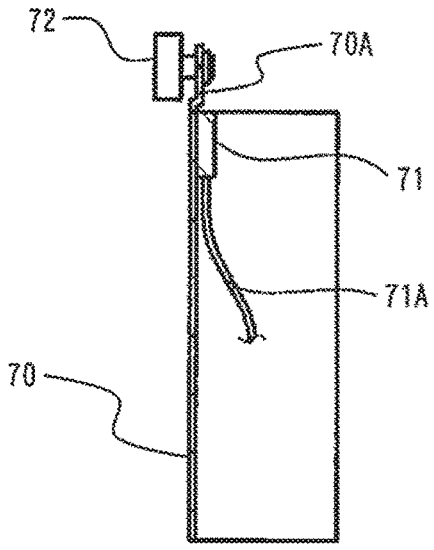
FIGS. 7A and 7B are a cross-sectional view and a bottom view of the maintenance cover according to the embodiment of the present invention, respectively.
Figure 7B:
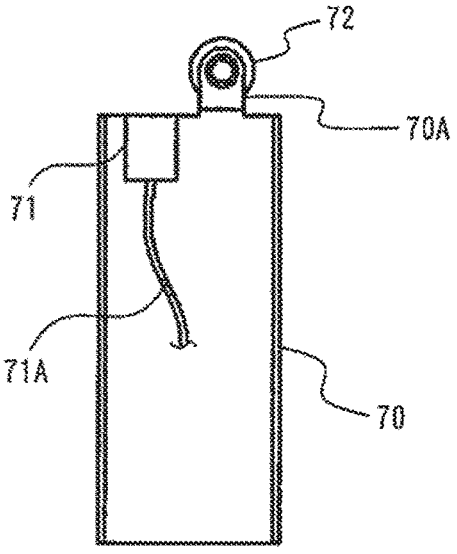

Subsequently, a configuration of a print head 2 of an inkjet recording device 400 according to Embodiment 2 is described with FIGS. 1 to 7B. FIG. 1 is a partial cross-sectional view showing an external appearance and an internal configuration of the print head 2 in the present embodiment. FIG. 2 is an external perspective view of the print head 2 in the present embodiment. FIG. 3 is a perspective view of the print head 2 in the present embodiment, where a maintenance cover 70 and a head cover 60 are removed from the print head 2. FIG. 4 is a perspective view of the print head 2 with the head cover 60 removed in the present embodiment. FIG. 5 is a partial cross-sectional view of the print head 2 with the head cover 60 removed in the present embodiment. FIGS. 6A and 6B are a cross-sectional view and a bottom view of the head cover 60 in the present embodiment, respectively.

In FIGS. 1 to 5, the print head 2 includes nozzles 8A and 8B from which ink 5 is ejected; charging electrodes 11A and 11B that are arranged in parallel and symmetrical about ink beams ejected from the nozzles 8A and 8B, respectively; deflection electrodes 12A and 12B each composed of two electrodes arranged on the secondary side of the charging electrodes 11A and 11B in an ink-beam flying direction; and gutters 14A and 14B with a hole for catching ink particles 7A and 7B not used in printing formed on the same axis as the ink beam.

The print head 2 further includes sealing valves 41A and 41B for controlling the supply of the ink 5 to the nozzles 8A and 8B through paths 209A and 209B. The sealing valves 41A and 41B close a flow path when no electric current is applied to the sealing valves 41A and 41B, and open the flow path when a predetermined electric current is applied to the sealing valves 41A and 41B. The sealing valves 41A and 41B are connected to a heater 40 through paths 208A and 208B, respectively. The heater 40 is controlled to heat the ink 5 to a predetermined temperature suited for printing (for example, 25° C.) when it is in a low-temperature (for example, 0° C.) environment.

A path 207 is connected to a pressure gauge 32 in a device body 1 through a duct 4 connected to the print head 2. Here, a tube made of Teflon (registered trademark), which is highly resistant to solvents, is used in the paths 209A and 209B, the paths 208A and 208B, and the path 207.

The nozzles 8A and 8B, the charging electrodes 11A and 11B, the deflection electrodes 12A and 12B, the gutters 14A and 14B, the sealing valves 41A and 41B, and the heater 40 are installed on a base 50G formed on a head base 50.

On each side surface of the head base 50, there are a horizontal uneven side portion 50A that is formed of a thin face extending from near the gutter 14 in parallel with the base 50G, an oblique uneven side portion 50B that is connected to the horizontal uneven side portion 50A and is formed of a thin face cut off in an oblique direction like it is away from the base 50G, and a horizontal uneven side portion 50C that is connected to the oblique uneven side portion 50B and is formed of a thin face parallel with the horizontal uneven side portion 50A.

The head base 50 further has a vertical uneven end portion 50E formed of a thin face vertical to the base 50G below the gutters 14A and 14B and a back uneven portion 50F between a contact part with the duct 4 and the heater 40. The head base 50 still further has a rib 50D formed between the nozzles 8A and 8B and the sealing valves 41A and 41B; the rib 50D extends in a direction vertical to the base 50G.

A partition member 51 is attached to the rib 50D so as to hold the paths 209A and 209B between the partition member 51 and the rib 50D. A dent portion 51A is formed on the upper part of the partition member 51 so as to avoid interference with a proximity sensor 71.

In FIGS. 1 to 7B, the maintenance cover 70 is attached to the print head 2 for the purpose of protecting the heater 40 and the sealing valves 41A and 41B. The maintenance cover 70 is fixed by being engaged with the back uneven portion 50F, the horizontal uneven side portion 50C, and the partition member 51. Therefore, in a state in which the maintenance cover 70 is attached to the print head 2, the space surrounded by the base 50G on the head base 50 and the maintenance cover 70 is protected from the impact or the like during maintenance. Parts covered with the maintenance cover 70 are the area a serviceman does maintenance. The proximity sensor 71 is attached to the maintenance cover 70 so as to be engaged with the dent portion 51A of the partition member 51, and an electric wire 71A for connecting the proximity sensor 71 and the device body 1 is attached to the maintenance cover 70. A fixing-screw attachment portion 70A is formed near the partition member 51 on the maintenance cover 70, and a fixing screw 72 is tightened up to fix the head cover 60.

Furthermore, the head cover 60 is attached to the print head 2 for the purpose of protecting the nozzles 8A and 8B, the charging electrodes 11A and 11B, the deflection electrodes 12A and 12B, and the gutters 14A and 14B. A notch portion 60F is formed on the head cover 60 so as to be engaged with the fixing screw 72 of the maintenance cover 70. A magnet 61 is attached to the head cover 60 so that the proximity sensor 71 can react when the magnet 61 comes close to the proximity sensor 71 and determine whether the head cover 60 is attached to the proper position.

The head cover 60 further has a slit 60D through which the ink particles 7A and 7B used in printing pass and a vertical uneven portion 60E formed to cover the gutters 14A and 14B. Then, on each side surface of the head cover 60, a horizontal bottom portion 60A connected in a direction perpendicular to the vertical uneven portion 60E, an oblique bottom portion 60B that is connected to the horizontal bottom portion 60A and is a face parallel with the oblique uneven side portion 50B, and a horizontal bottom portion 60C that is connected to the oblique bottom portion 60B and is a face parallel with the horizontal bottom portion 60A.

In a state in which the head cover 60 is attached to the print head 2, the horizontal uneven side portion 50C is engaged with the horizontal bottom portion 60C, the horizontal uneven side portion 50A is engaged with the horizontal bottom portion 60A, and the vertical uneven end portion 50E is engaged with the vertical uneven portion 60E.

[Operation in Embodiment 2]

The operation of the inkjet recording device 400 according to Embodiment 2 when fixing the head cover 60 to the print head 2 is described with FIGS. 8A to 8D. Moving the head cover 60 in a horizontal direction facilitates the attachment and removal of parts during maintenance of the print head 2.

Figure 8A:
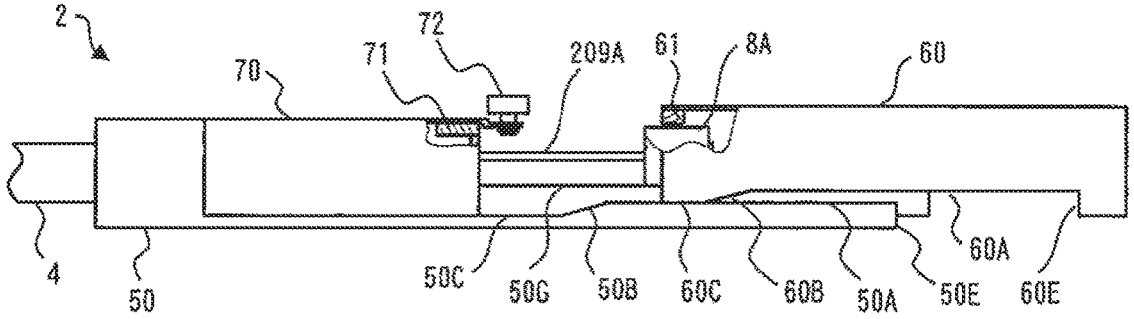
FIGS. 8A to 8D are cross-sectional views showing the process of how the print head cover is attached to the print head according to the embodiment of the present invention.

First, FIG. 8A shows a state in which the magnet 61 attached to the head cover 60 is located on top of the nozzle 8A. The print head 2 is in a state in which the horizontal uneven side portion 50A is in contact with the horizontal bottom portion 60C, and, when the head cover 60 is fixed to the print head 2, by moving the position of the magnet 61 upward, the magnet 61 is prevented from colliding with the nozzle 8A.

Figure 8B:
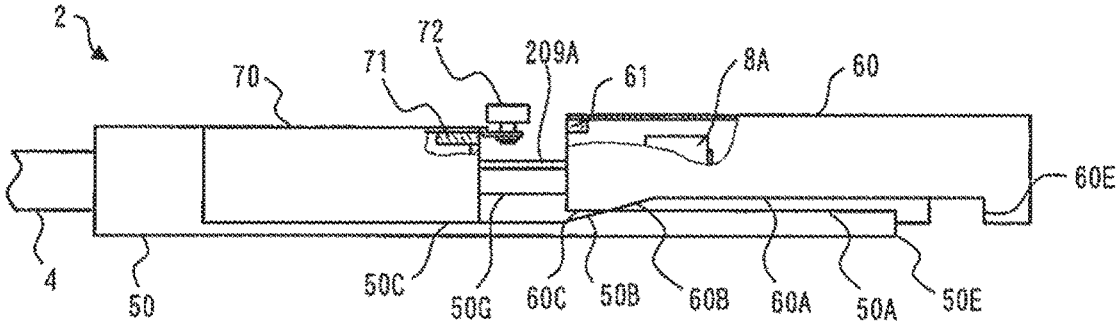

Then, FIG. 8B shows a state in which the head cover 60 is moved to a direction of the maintenance cover 70 than that in FIG. 8A. The magnet 61 has already passed the top of the nozzle 8A, and there is no obstacle below the magnet 61.

Figure 8C:
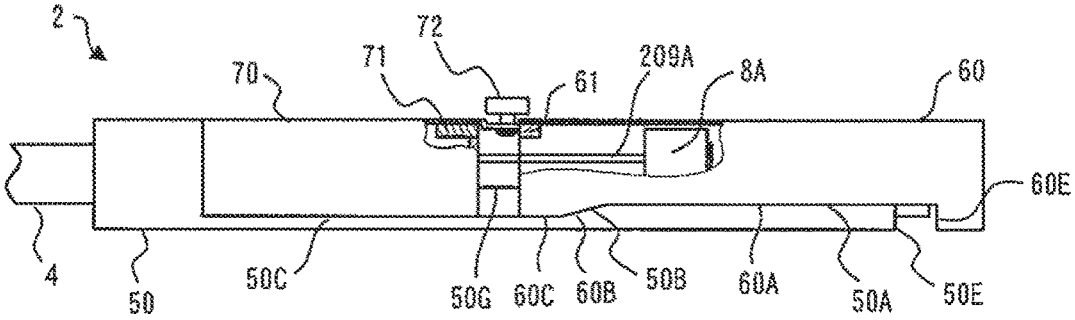

Then, FIG. 8C shows a state of the print head 2 in which the head cover 60 is further moved to the direction of the maintenance cover 70 than that in FIG. 8B. In the print head 2, the horizontal uneven side portion 50C is in contact with the horizontal bottom portion 60C, the oblique uneven side portion 50B is in contact with the oblique bottom portion 60B, the horizontal uneven side portion 50A is in contact with the horizontal bottom portion 60A, and the vertical uneven end portion 50E is in contact with the vertical uneven portion 60E. In this state, the head cover 60 is further moved downward than that in FIG. 8B, and is on the same level as when fixed.

Figure 8D:
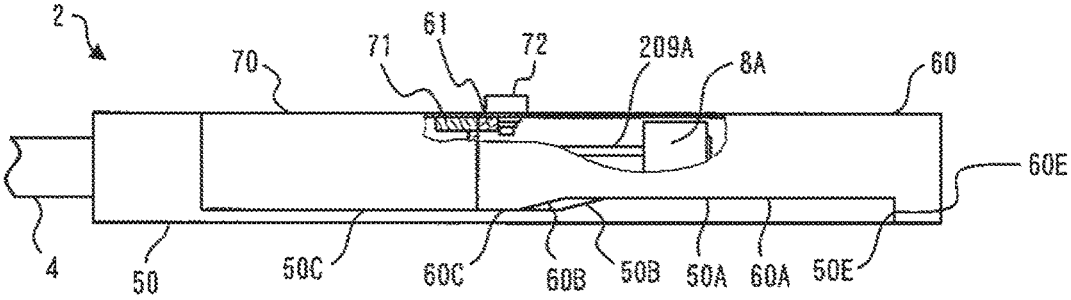

Next, FIG. 8D shows a state of the print head 2 in which the head cover 60 is fixed. The head cover 60 is fixed with the fixing screw 72 in a state in which the head cover 60 is in contact with the maintenance cover 70. Furthermore, the magnet 61 comes close to the reaction distance of the proximity sensor 71. Therefore, the inkjet recording device 400 can detect that the head cover 60 is fixed to the print head 2.

[Advantageous Effects of Embodiment 2]

In this way, according to the present embodiment, it is possible to prevent the installed parts from colliding with each other when the head cover 60 is attached to or removed from the print head 2; therefore, it is possible to improve the maintainability. Furthermore, it is only necessary to adopt the structure in which the installed parts are prevented from colliding with each other in a state in which the head cover 60 is attached to the print head 2; therefore, it is possible to provide the inkjet recording device 400 including the compact print head 2 as compared with a case in which the configuration in the present invention is not used.

The present invention is not limited to the above-described embodiment, and includes various variations. Furthermore, the above embodiment is described in detail to provide a comprehensible explanation about the present invention, and is not always limited to ones including all the components described above.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An inkjet recording device comprising:

an ink container that contains ink used to print on a printed object;

a pump that pressures and feeds the ink;

a plurality of nozzles that are disposed in a print head and connected to the ink container, and from which the ink is ejected;

a forked path connecting from the ink container to the plurality of nozzles;

a flow control valve installed on a pipe connecting from the forked path to the plurality of nozzles, where the flow control valve is provided separately from the pump;

a plurality of sealing valves disposed in the print head, each of the plurality of sealing valves being configured to open a flow path that allows the ink to be supplied to one of the plurality of nozzles;

a plurality of gutters that collect the ink not used in printing;

a plurality of ink collection paths that are connected to the plurality of gutters;

a plurality of ink collection pumps that are connected to the plurality of ink collection paths;

a single exhaust air path of a solvent vapor connected to the ink container; and solenoid valves for ink collection that are provided between the plurality of gutters and the plurality of ink collection pumps.

2. The inkjet recording device according to claim 1, further comprising:

a single ink supply path connected to the ink container, wherein the pump is a single ink supply pump connected to the ink supply path.

3. The inkjet recording device according to claim 1, wherein the plurality of ink collection pumps are capable of controlling a running of each of the ink collection pumps individually.

4. The inkjet recording device according to claim 1, wherein at least one of the plurality of ink collection paths is capable of stopping a flow of the ink at a nozzle side that an ejection of the ink is stopped.

5. The inkjet recording device according to claim 1, wherein at least one of the plurality of ink collection paths is capable of sucking a gas by running the plurality of ink collection pumps while stopping a flow of the ink at a nozzle side that an ejection of the ink is stopped.

6. The inkjet recording device according to claim 1, wherein the ink is capable of being concentrated by sucking a gas from the plurality of gutters.

7. The inkjet recording device according to claim 1, wherein a hole diameter of an ink ejection for at least one of the plurality of nozzles is different from a hole diameter of an ink ejection for the other nozzles.

8. The inkjet recording device according to claim 1, further comprising:

different kinds of collection filters connected to the plurality of ink collection paths.

9. The inkjet recording device according to claim 1, further comprising:

collection filters having different replacement cycles connected to the plurality of ink collection paths.

10. The inkjet recording device according to claim 1, wherein the forked path is disposed in a print head.

11. The inkjet recording device according to claim 1, wherein the exhaust air path is configured to be in fluid communication with an outside of a device body of the inkjet recording device.

12. The inkjet recording device according to claim 1, further comprising:

a control unit, wherein the control unit independently controls each of the solenoid valves and the plurality of ink collection pumps, respectively, and independently controls an ejection and a collection of the ink from the plurality of nozzles.

13. The inkjet recording device according to claim 12, wherein the sealing valves are independently controlled to supply the ink to the plurality of nozzles.

14. The inkjet recording device according to claim 12, further comprising:

a heater for heating the ink on an ink supply path from the pump for supply to the forked path.

* * * * *